US006786580B1

(12) United States Patent
Gray et al.

(10) Patent No.: US 6,786,580 B1
(45) Date of Patent: Sep. 7, 2004

(54) SUBMERSIBLE INK SOURCE REGULATOR FOR AN INKJET PRINTER

(75) Inventors: Trevor Daniel Gray, Midway, KY (US); Steven Robert Komplin, Lexington, KY (US); Matthew Joe Russell, Stamping Ground, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/465,385

(22) Filed: Jun. 18, 2003

(51) Int. Cl.[7] ..... B41J 2/175
(52) U.S. Cl. ..... 347/85
(58) Field of Search ..... 347/85, 86, 87

(56) References Cited

U.S. PATENT DOCUMENTS

| | | | | |
|---|---|---|---|---|
| 3,940,773 | A | 2/1976 | Mizoguchi et al. | 347/68 |
| 4,303,929 | A | 12/1981 | Blanck | 347/86 |
| 4,336,544 | A | 6/1982 | Donald et al. | 347/54 |
| 4,380,018 | A | 4/1983 | Andoh et al. | 347/68 |
| 4,462,428 | A | 7/1984 | Guenther et al. | 137/868 |
| 4,480,259 | A | 10/1984 | Kruger et al. | 347/63 |
| 4,604,633 | A | 8/1986 | Kimura et al. | 347/7 |
| 4,641,154 | A | 2/1987 | Mikalsen | 347/88 |
| 4,685,185 | A | 8/1987 | Boso et al. | 29/890.1 |
| 4,734,706 | A | 3/1988 | Le et al. | 347/71 |
| 4,734,711 | A | 3/1988 | Piatt et al. | 347/17 |
| 4,860,787 | A | 8/1989 | Grosselin | 137/487.5 |
| 4,910,529 | A | 3/1990 | Regnault | 347/6 |
| 4,914,453 | A | 4/1990 | Kanayama et al. | 347/86 |
| 5,040,002 | A | 8/1991 | Pollacek et al. | 347/87 |
| 5,126,755 | A | 6/1992 | Sharpe et al. | 347/54 |
| 5,426,459 | A | 6/1995 | Kaplinsky | 399/320 |
| 5,440,333 | A | 8/1995 | Sykora et al. | 347/87 |
| 5,451,995 | A | 9/1995 | Swanson et al. | 347/87 |
| 5,541,632 | A | 7/1996 | Khodapanah et al. | 347/87 |
| 5,574,490 | A | 11/1996 | Gragg et al. | 347/87 |
| 5,583,545 | A | 12/1996 | Pawlowski, Jr. et al. | 347/7 |
| 5,594,483 | A | 1/1997 | Kaplinsky et al. | 347/87 |
| 5,610,643 | A | 3/1997 | Kutami et al. | 347/54 |
| 5,644,341 | A | 7/1997 | Fujii et al. | 347/11 |
| 5,646,666 | A | 7/1997 | Cowger et al. | 347/87 |
| 5,650,811 | A | 7/1997 | Seccombe et al. | 347/85 |
| 5,666,141 | A | 9/1997 | Matoba et al. | 347/54 |
| 5,719,609 | A | 2/1998 | Hauck et al. | 347/85 |
| 5,736,992 | A | 4/1998 | Pawlowski, Jr. | 347/7 |
| 5,737,001 | A | 4/1998 | Taylor | 347/85 |
| 5,745,137 | A | 4/1998 | Scheffelin et al. | 347/85 |
| 5,751,319 | A | 5/1998 | Robertson et al. | 347/85 |
| 5,757,401 | A | 5/1998 | Abe et al. | 347/48 |
| 5,757,406 | A | 5/1998 | Kaplinsky et al. | 347/87 |

(List continued on next page.)

*Primary Examiner*—Anh T. N. Vo

(57) ABSTRACT

A print head and regulator assembly for a printer including: (a) a print head; (b) an ink source; and, (c) a regulator for regulating the flow of ink between the ink source and the print head, the regulator including: (i) a pressurized chamber having an ink inlet in fluid communication with the ink source, an ink outlet in fluid communication with the print head, an opening extending through a chamber wall, and a flexible film covering the opening, the flexible film having an inner surface facing an interior of the pressurized chamber and an outer surface in contact with the ink in the ink source; and, (ii) a lever including a flexible arm positioned in proximity to the inner surface of the flexible film and an opposing arm operatively coupled to a seal that closes the ink inlet when the lever is in a first position and opens the ink inlet when the lever is pivoted to a second position, the lever being biased to the first position, where a higher pressure differential across the flexible film brings about a higher force acting upon the flexible arm to overcome the bias and pivot the lever to the second position opening the ink inlet, and, where a lower pressure differential across the flexible film brings about a lesser force acting upon the flexible arm resulting in the lever succumbing to the bias and repositioning the seal at the first position, closing the ink inlet.

44 Claims, 12 Drawing Sheets

U.S. PATENT DOCUMENTS

| | | | | |
|---|---|---|---|---|
| 5,771,053 | A | 6/1998 | Merrill | 347/86 |
| 5,777,647 | A | 7/1998 | Pawlowski, Jr. et al. | 347/86 |
| 5,781,213 | A | 7/1998 | Ujita et al. | 347/86 |
| 5,812,163 | A | 9/1998 | Wong | 347/68 |
| 5,812,168 | A | 9/1998 | Pawlowski, Jr. et al. | 347/92 |
| 5,821,966 | A | 10/1998 | Schell et al. | 347/86 |
| 5,825,383 | A | 10/1998 | Abe et al. | 347/54 |
| 5,838,351 | A | 11/1998 | Weber | 347/85 |
| 5,844,577 | A | 12/1998 | Pawlowski, Jr. | 347/6 |
| 5,847,734 | A | 12/1998 | Pawlowski, Jr. | 347/86 |
| 5,894,316 | A | 4/1999 | Sakai et al. | 347/54 |
| 5,912,688 | A | 6/1999 | Gragg | 347/86 |
| 5,923,353 | A | 7/1999 | Boyd et al. | 347/85 |
| 5,975,686 | A | 11/1999 | Hauck et al. | 347/85 |
| 5,980,028 | A | 11/1999 | Seccombe | 347/85 |
| 5,992,986 | A | 11/1999 | Gyotoku et al. | 347/85 |
| 6,000,785 | A | 12/1999 | Sakai et al. | 347/54 |
| 6,007,190 | A | 12/1999 | Murray et al. | 347/86 |
| 6,010,211 | A | 1/2000 | Betschon | 347/86 |
| 6,074,043 | A | 6/2000 | Ahn | 347/54 |
| 6,079,813 | A | 6/2000 | Tuli | 347/54 |
| 6,084,617 | A | 7/2000 | Balazer | 347/86 |
| 6,106,180 | A | 8/2000 | Anderka | 401/145 |
| 6,130,690 | A | 10/2000 | Ahn | 347/54 |
| 6,130,694 | A | 10/2000 | Beatty | 347/85 |
| 6,164,744 | A | 12/2000 | Froger et al. | 347/7 |
| 6,168,267 | B1 | 1/2001 | Komplin | 347/86 |
| 6,183,071 | B1 | 2/2001 | Sugimoto et al. | 347/85 |
| 6,199,977 | B1 | 3/2001 | Komplin et al. | |
| 6,203,146 | B1 | 3/2001 | Pawlowski, Jr. et al. | 347/85 |
| 6,206,515 | B1 | 3/2001 | Swanson et al. | 347/87 |
| 6,217,153 | B1 | 4/2001 | Silverbrook | 347/54 |
| 6,217,157 | B1 | 4/2001 | Yoshihira et al. | 347/65 |
| 6,227,654 | B1 | 5/2001 | Silverbrook | 347/54 |
| 6,228,050 | B1 | 5/2001 | Olsen et al. | 604/93.01 |
| 6,243,115 | B1 | 6/2001 | Baker et al. | 347/85 |
| 6,247,791 | B1 | 6/2001 | Silverbrook | 347/54 |
| 6,250,747 | B1 | 6/2001 | Hauck | 347/86 |
| 6,257,699 | B1 | 7/2001 | Tracy et al. | 347/40 |
| 6,257,714 | B1 | 7/2001 | Seccombe | 347/92 |
| 6,260,961 | B1 | 7/2001 | Seu et al. | 347/87 |
| 6,270,204 | B1 | 8/2001 | Barrett et al. | 347/74 |
| 6,273,151 | B1 | 8/2001 | Kong | 141/18 |
| 6,290,348 | B1 | 9/2001 | Becker et al. | 347/87 |
| 6,312,116 | B2 | 11/2001 | Underwood et al. | 347/86 |
| 6,312,615 | B1 | 11/2001 | Silverbrook | 216/27 |
| 6,318,851 | B1 | 11/2001 | Hoen et al. | 347/92 |
| 6,325,354 | B1 | 12/2001 | Hoen et al. | 251/65 |
| 6,328,421 | B1 | 12/2001 | Kojima et al. | 347/46 |
| 6,331,050 | B1 | 12/2001 | Nakata et al. | 347/65 |
| 6,331,054 | B1 | 12/2001 | Seu et al. | 347/87 |
| 6,341,853 | B1 | 1/2002 | Scheffelin et al. | 347/87 |
| 6,364,471 | B1 | 4/2002 | Seccombe | 347/85 |
| 6,365,701 | B1 | 4/2002 | Hayashi et al. | 528/75 |
| 6,371,605 | B1 | 4/2002 | Komplin et al. | |
| 6,382,784 | B2 | 5/2002 | Pawlowski, Jr. et al. | 347/85 |
| 6,390,603 | B1 | 5/2002 | Silverbrook | 347/54 |
| 6,412,911 | B1 | 7/2002 | Hilton et al. | 347/49 |
| 6,416,165 | B1 | 7/2002 | Meyer et al. | 347/49 |
| 6,422,691 | B2 | 7/2002 | Kobayashi et al. | 347/86 |
| 6,428,140 | B1 | 8/2002 | Cruz-Uribe | 347/20 |
| 6,428,141 | B1 | 8/2002 | McElfresh et al. | 347/40 |
| 6,428,147 | B2 | 8/2002 | Silverbrook | 347/54 |
| 6,460,778 | B1 | 10/2002 | Silverbrook | 239/102.1 |
| 6,478,406 | B1 | 11/2002 | Silverbrook | 347/54 |
| 6,500,354 | B1 | 12/2002 | Lee et al. | 216/27 |
| 6,508,545 | B2 | 1/2003 | Dowell et al. | 347/85 |
| 6,527,357 | B2 | 3/2003 | Sharma et al. | 347/17 |
| 6,536,875 | B1 | 3/2003 | Pan | 347/54 |
| 2001/0006395 | A1 | 7/2001 | Pawlowski, Jr. et al. | 347/85 |
| 2001/0013886 | A1 | 8/2001 | Underwood et al. | 347/86 |
| 2001/0017641 | A1 | 8/2001 | Kobayashi et al. | 347/85 |
| 2001/0019347 | A1 | 9/2001 | Hauck | 347/86 |
| 2001/0030675 | A1 | 10/2001 | Kobayashi et al. | 347/86 |
| 2001/0040612 | A1 | 11/2001 | Shimizu | 347/86 |
| 2002/0008744 | A1 | 1/2002 | Otis et al. | 347/85 |
| 2002/0024573 | A1 | 2/2002 | Hoen et al. | 347/92 |
| 2002/0036680 | A1 | 3/2002 | Hall et al. | 347/85 |
| 2002/0039124 | A1 | 4/2002 | Nanjo et al. | 347/49 |
| 2002/0054194 | A1 | 5/2002 | Seccombe | 347/86 |
| 2002/0080216 | A1 | 6/2002 | Dowell et al. | 347/85 |
| 2002/0105567 | A1 | 8/2002 | Yamada et al. | 347/87 |
| 2002/0145650 | A1 | 10/2002 | Pan et al. | 347/85 |
| 2002/0186284 | A1 | 12/2002 | Anma et al. | 347/85 |
| 2002/0191061 | A1 | 12/2002 | Dowell et al. | 347/94 |
| 2003/0016279 | A1 | 1/2003 | Hayashi et al. | 347/87 |
| 2003/0052944 | A1 | 3/2003 | Schefflin et al. | 347/49 |

101

SUBMERSIBLE INK SOURCE REGULATOR FOR AN INKJET PRINTER

BACKGROUND

1. Field of the Invention

The present invention is directed to a regulator for regulating the flow of ink from an ink source to a print head in a printer; and, more particularly, to a regulator that is submersible within an ink reservoir and that operates relatively independent of the inlet ink pressure.

2. Background of the Invention

The flow of fluids through predetermined conduits has been generally been accomplished using a valve and/or a pressure source. More specifically, valves come in various shapes and sizes and include as a subset, check valves. These valves prevent the reversal of fluid flow from the direction the fluid passed by the valve. A limitation of check valves is that the volumetric flow of the fluid past the valve is controlled by the inlet side fluid pressure. If the inlet pressure is greater than the outlet pressure, the valve will open and fluid will pass by the valve; if not, the inlet fluid will be relatively stagnant and the valve will not open.

Inkjet printers must take ink from an ink source and direct the ink to the print head where the ink is selectively deposited onto a substrate to form dots comprising an image discernable by the human eye. Two general types of systems have been developed for providing the pressure source to facilitate movement of the ink from the ink source to the print head. These generally include gravitational flow system and pumping systems. Pumping systems as the title would imply create an artificial pressure differential between the ink source and the print head to pump the fluid from the ink source to the print head. Generally, these pumping systems have many moving parts and need complex flow control system operatively coupled thereto. Gravitational flow avoids many of these moving parts and complex systems.

Gravitational fluid flow is the most common way of delivering ink from an ink reservoir to a print head for eventual deposition onto a substrate, especially when the print head includes a carrier for the ink source. However, this gravitational flow may cause a problem in that excess ink is allowed to enter the print head and accumulate, being thereafter released or deposited onto an unintended substrate or onto one or more components of the inkjet printer. Thus, the issue of selective control of ink flow from a gravitational source has also relied upon the use of valves. As discussed above, a check valve has not unitarily been able to solve the problems of regulating ink flow, at least in part because the inlet pressure varies with atmospheric pressure, and when the valve is submerged, the pressure exerted by the fluid itself.

U.S. Pat. No. 6,422,693, entitled "Ink Interconnect Between Print Cartridge and Carriage", assigned to Hewlett-Packard Company, describes an internal regulator for a print cartridge that regulates the pressure of the ink chamber within the print cartridge. The regulator design includes a plurality of moving parts having many complex features. Thus, there is a need for a regulator to regulate the flow of ink from an ink source to a print head that includes fewer moving parts, that is relatively easy to manufacture and assemble, that is submersible within an ink source without necessitating direct coupling to the atmosphere to properly function.

SUMMARY OF THE INVENTION

The invention is directed to a mechanical device providing control over the flow of a fluid from a fluid source to at least a point of accumulation. More specifically, the invention is directed to an ink flow regulator that selectively allows fluid communication between the ink source and the print head so as to supply the print head with ink, while substantially inhibiting the free flow through of print head. The invention comprises a pressurized chamber, generally exhibiting negative gauge pressure therewithin, having an ink flow inlet and an ink flow outlet. A seal is biased against the ink inlet to allow selective fluid communication between the interior of the pressurized chamber and an ink source. A flexible wall, acting as a diaphragm, is integrated with a chamber wall to selectively expand outwardly from and contract inwardly towards the interior of the chamber depending upon the relative pressure differential across the flexible wall. The pressure differential depends upon the pressure of the interior of the chamber verses the pressure on the outside of the flexible wall. Operability of the invention is not negated by having the invention partially submerged or fully submerged beneath a fluid, nor is operability inhibited by having a liquid or a gas contacting the exterior of the flexible wall.

As the flexible wall contracts inwardly toward the interior of the chamber, it actuates a lever. The lever includes a sealing arm and an opposing flexible arm, and pivots on a fulcrum. The sealing arm includes the seal biased against the ink inlet, while the flexible arm is angled with respect to the sealing arm and includes a spoon-shaped end contacting the flexible wall. As the flexible wall continues contracting inward, the flexible arm flexes without pivoting the lever until the force of the wall against the flexible arm is sufficient to overcome the bias biasing the sealing arm against the inlet. When the force against the lever is sufficient to overcome the bias, the lever pivots about the fulcrum to release the seal at the ink inlet, thereby allowing ink to flow into the chamber until the pressure differential is reduced such that the bias again overcomes the reduced push created by the inward contraction of the flexible wall.

It is noted that the invention is not a check valve, as the operation of the regulator is independent from the inlet pressure when the regulator is not submerged within a liquid, and minimally dependent upon inlet pressure when the regulator is submerged within a liquid. In other words, a check valve is wholly dependent upon the inlet pressure, whereas this system of the present invention provides a relatively small inlet cross sectional area in relation to the size and relative forces action upon the regulator system that effectively negates any variance in inlet pressure. Thus, increasing the inlet pressure does not affect the operation of the regulator.

It is a first aspect of the present invention to provide a print head and regulator assembly for a printer that includes: (a) a print head; (b) an ink source; and, (c) a regulator for regulating the flow of ink between the ink source and the print head, the regulator including: (i) a pressurized chamber having an ink inlet in fluid communication with the ink source, an ink outlet in fluid communication with the print head,an opening extending through a chamber wall, and a flexible film covering the opening, the flexible film having an inner surface facing an interior of the pressurized chamber and an outer surface in contact with a liquid; and, (ii) a lever including a flexible arm positioned in proximity to the inner surface of the flexible film and an opposing arm operatively coupled to a seal that closes the ink inlet when the lever is in a first position and opens the ink inlet when the lever is pivoted to a second position; where the lever is biased to the first position; where a higher pressure differential across the flexible film brings about a higher force acting upon the flexible arm to overcome the bias and pivot the lever to the second position opening the ink inlet; and where a lower pressure differential across the flexible film brings about a lesser force acting upon the flexible arm resulting in the lever succumbing to the bias and repositioning the seal at the first position, closing the ink inlet.

In a more detailed embodiment of the first aspect, the ink source is an ink reservoir, and the regulator is at least partially submerged within the ink reservoir and the liquid contacting the outer surface of the flexible film is ink within the ink reservoir.

In another more detailed embodiment, the operating pressure on the interior of the pressurized chamber is between about 5 centimeters water column negative pressure and about 20 centimeters water column negative pressure In a further detailed embodiment, the volume of ink exiting the pressurized chamber between sequential occurrences of the lever pivoting to the second position ranges from about 0.1 mL and about 1.5 mL. In still a further detailed embodiment, the ink inlet is operatively coupled to a siphon tube in fluid communication with the ink source. In yet another detailed embodiment, the flexible film contacts and spatially conforms to the shape of the flexible arm between the first and second positions. In an additional detailed embodiment, the flexible film is a non-elastomeric film. In another detailed embodiment, the regulator is fully submerged within the ink reservoir. In still another detailed embodiment, the lever is biased to the first position by a spring, and the spring constant is dependent upon a depth of submersion of the regulator within the ink reservoir.

It is a second aspect of the present invention to provide an ink cartridge that includes: (a) at least one ink reservoir; and, (b) at least one regulator for regulating the flow of ink between the ink reservoir and an ink cartridge outlet, the regulator including: (i) a pressurized chamber having an ink inlet in fluid communication with the ink reservoir, an ink outlet in fluid communication with the ink cartridge outlet, an opening extending through a chamber wall, and a flexible film covering the opening, the flexible film having an inner surface facing an interior of the pressurized chamber and an outer surface in contact with a liquid; and, (ii) a lever including a flexible arm positioned in proximity to the inner surface of the flexible film and an opposing arm operatively coupled to a seal that closes the ink inlet when the lever is in a first position and opens the ink inlet when the lever is pivoted to a second position, the lever being biased to the first position; where a higher pressure differential across the flexible film brings about a higher force acting upon the flexible arm to overcome the bias and pivot the lever to the second position opening the ink inlet; and where a lower pressure differential across the flexible film brings about a lesser force acting upon the flexible arm resulting in the lever succumbing to the bias and repositioning the seal at the first position, closing the ink inlet.

In a more detailed embodiment of the second aspect, the regulator is at least partially submerged within the ink reservoir such that the liquid contacting the outer surface of the flexible film is ink within the ink reservoir. In another more detailed embodiment, the operating pressure on the interior of the pressurized chamber is between about 5 centimeters water column negative pressure and about 20 centimeters water column negative pressure. In a further detailed embodiment, the volume of ink exiting the pressurized chamber between sequential occurrences of the lever pivoting to the second position ranges from about 0.1 mL and about 1.5 mL. In still a further detailed embodiment, the ink inlet is operatively coupled to a siphon tube in fluid communication with the ink source. In yet another detailed embodiment, the flexible film is a non-elastomeric film. In an additional detailed embodiment, the flexible film contacts and spatially conforms to the shape of the flexible arm between the first and second positions. In a more detailed embodiment, the lever is biased to the first position by a spring, and the spring constant is dependent upon a depth of submersion of the regulator within the ink reservoir. In another detailed embodiment, the ink cartridge includes a plurality of the ink reservoirs and a respective plurality of the regulators at least partially submerged within respective ink reservoirs. In still another detailed embodiment, the regulator is fully submerged within the ink reservoir.

It is a third aspect of the present invention to provide a method of regulating the flow of ink from an ink source to a print head nozzle comprising the steps of: (a) positioning an ink regulator having a pressurized chamber in fluid communication with an ink stream between an ink source and a print head; (b) contacting a flexible wall of the ink regulator with a liquid responsive to a pressure exerted upon ink upstream from the ink regulator; (c) actuating the flexible wall in response to a pressure differential across the flexible wall between a fluid inside the pressurized chamber and the liquid; and, (d) opening or closing at least one valve selectively in response to actuation of the flexible wall to provide fluid communication between a first point an a second point of the ink stream.

In a more detailed embodiment of the third aspect, the positioning step includes the step of submerging, at least partially, the ink regulator within the ink source such that the liquid contacting the flexible wall of the ink regulator is ink in the ink source. In a further detailed embodiment, an additional step includes pivoting a lever in response to the actuating step to open the valve, where the valve is biased closed and resists the lever pivoting. In still a further detailed embodiment, the operating pressure of the pressurized chamber is between about 5 centimeters water column negative pressure and about 20 centimeters water column negative pressure In yet another detailed embodiment, the flexible wall is a non-elastomeric film bonded over an opening in the pressurized chamber. In an additional detailed embodiment, the volume of ink exiting the pressurized chamber between sequential opening of the valve ranges from about 0.1 mL and about 1.5 mL. In a more detailed embodiment, the valve is biased to a closed position and the method further includes the step of correlating the bias of the valve with a depth of submersion of the ink regulator within the ink source.

DETAILED DESCRIPTION

Figure 1:
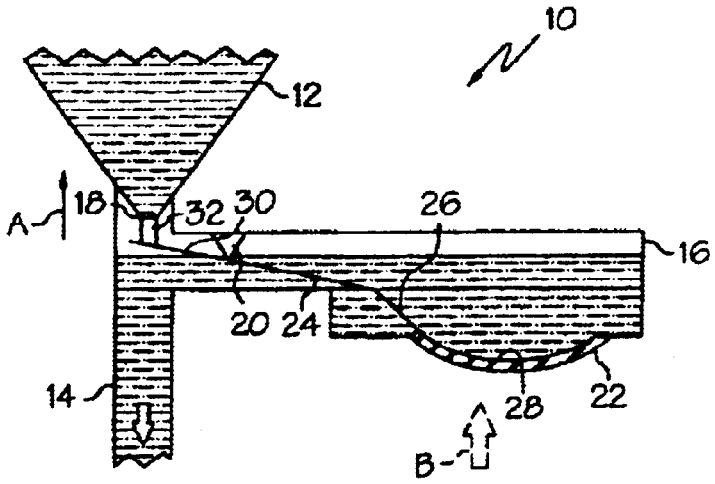
FIG. 1 is a cross-sectional, schematic, first stage representation of an exemplary embodiment of the present invention.

The exemplary embodiments of the present invention are described and illustrated below as ink regulators and/or ink cartridges (reservoirs) utilizing such regulators, for regulating the volumetric flow of ink between an ink source and a point of expulsion, generally encompassing a print head. The various orientational, positional, and reference terms used to describe the elements of the inventions are therefore used according to this frame of reference. Further, the use of letters and symbols in conjunction with reference numerals denote analogous structures and functionality of the base reference numeral. Of course, it will be apparent to those of ordinary skill in the art that the preferred embodiments may also be used in combination with one or more components to produce a functional ink cartridge for an inkjet printer. In such a case, the orientational or positional terms may be different. However, for clarity and precision, only a single orientational or positional reference will be utilized; and, therefore it will be understood that the positional and orientational terms used to describe the elements of the exemplary embodiments of the present invention are only used to describe the elements in relation to one another. For example, the regulator of the exemplary embodiments may be submerged within an ink reservoir and positioned such that the lengthwise portion is aligned vertically therein, thus effectively requiring like manipulation with respect to the orientational explanations.

Figure 2:
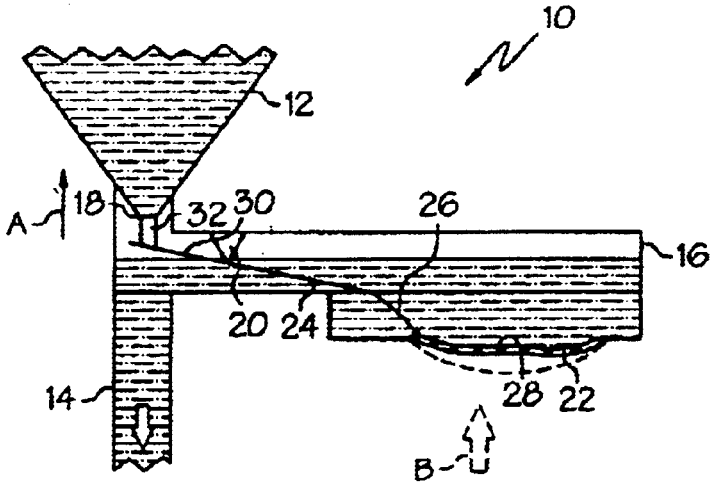
FIG. 2 is a cross-sectional, schematic, second stage representation of the. exemplary embodiment of FIG. 1.
Figure 3:
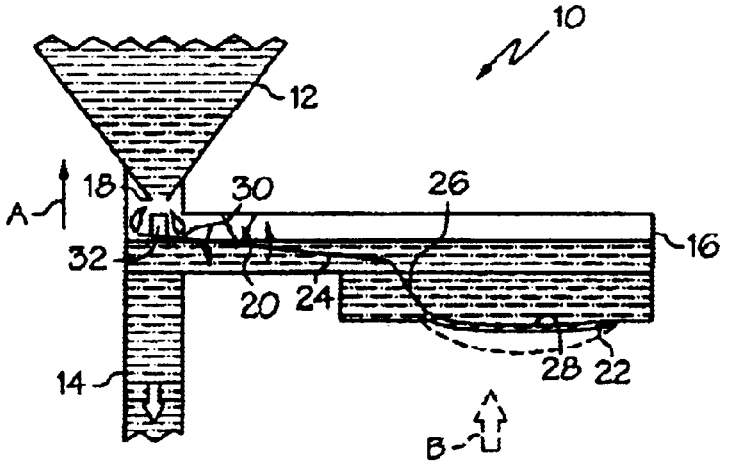
FIG. 3 is a cross-sectional, schematic, third stage representation of the exemplary embodiment of FIGS. 1 and 2.

As shown in FIGS. 1–3, an ink regulator 10 for regulating the volumetric flow of ink traveling between an ink source 12 and a print head in fluid communication with an ink outlet 14 generally includes: a pressurized chamber 16 including an ink inlet 18 in fluid communication with the ink source 12, the ink outlet 14 in fluid communication with the print head, and at least one flexible wall 22 or diaphragm; and a lever 24, pivoting on a fulcrum 20, including a flexible arm 26 having a spoon-shaped end 28 extending along a portion of the flexible wall 22 (diaphragm) and an opposing arm 30 operatively coupled to an inlet sealing member 32. The lever 24 is pivotable between a first position as shown in FIG. 1, in which the sealing member 32 presses against the ink inlet 18 to close the ink inlet, to a second position as shown in FIG. 3, in which the sealing member 32 is moved away from the ink inlet 18 to open the ink inlet and allow fluid communication between the ink inlet and the pressurized chamber 16. The lever 24 is biased (as shown by arrow A)to be in the first position, closing the ink inlet 18. The pressure within the pressurized chamber is set to be lower than that of the ambient pressure (shown by arrow B) outside of the flexible wall/diaphragm 22; and, as long as the ink inlet 18 remains closed, the pressure differential along the flexible wall will increase as ink flows through the outlet 14 to the print head. Consequently, a lower pressure differential across the flexible wall 22 causes the flexible wall 22 to expand/inflate and, thereby, pull the spoon-shaped end 28 of the flexible arm 26 contacting the flexible wall to pivot the lever 24 to the first position (closing the ink inlet in FIG. 1). Actually, the bias (represented by arrow A) causes the lever 24 to pivot when the flexible wall 22 no longer applies sufficient force against the spoon-shaped end 28 of the flexible arm to overcome the bias. A higher pressure differential across the flexible wall 22 causes the flexible wall to contract/deflate and, thereby, actuate the flexible arm contacting the flexible wall 22 so as to pivot the lever 24 to the second position (opening the ink inlet 18 as shown in FIG. 3), overcoming the bias (represented by arrow A). Also, when the pressure differential increases from the lower pressure differential to the higher pressure differential across the flexible wall 22 (resulting from ink flowing from the chamber 16 to the print head), the flexible wall 22 is caused to begin contracting/deflating and, thereby, actuate and flex the flexible arm 26 without causing the lever 24 to substantially pivot (as shown in FIG. 2).

The regulator will typically function in a cyclical process as shown in FIGS. 1–3. Referencing FIG. 1, the regulator is mounted to an ink outlet 14, such as a print head, and the inlet 18 is in fluid communication with an ink source 12. Generally, the contents of the chamber 16 will be under a lower pressure than the surrounding atmosphere (represented by Arrow B), thereby creating "back pressure" within the chamber 16. At this stage, the chamber 16 contains a certain amount of ink therein and the closed seal 32 prohibits ink from entering the chamber from the ink source 12, as the pressure differential across the flexible wall 22 is relatively low. The flexible wall 22 is in contact with the spoon-shaped end 28 of the lever's flexible arm 28. The lever is also biased (by a spring, for example) in this closed orientation.

Referencing FIG. 2, as ink continues to leave the chamber 16, the pressure within the chamber 16 begins to decrease, which, in turn, causes the pressure differential across the flexible wall 22 to increase (assuming the pressure on the outside of the flexible wall remains relatively constant). This increasing pressure differential causes the flexible wall 22 to begin to contract/deflate. Because the flexible wall 22 is in contact with the spoon-shaped end portion 28 of the lever's flexible arm 26, this contraction/deflation of the flexible wall causes the lever to flex, but not substantially pivot since the force of the flexible wall against the lever's flexible arm is not yet strong enough to overcome the bias.

Referencing FIG. 3, as ink continues to leave the chamber 16 and further increase the pressure differential across the flexible wall, the flexible wall 22 will contract/deflate to an extent that the inward pressure of the flexible wall against the flexible arm 26 of the lever overcomes the static force of the bias to pivot the lever 24 to its open position, thereby releasing the seal between the seal 32 and the ink inlet 18.

Thus, the bias and the properties of the lever enable the lever 24 to flex first, and thereafter when the amount of force applied to the lever is greater than the force applied by the spring to bias the lever closed, the lever pivots. This relatively high pressure differential between the contents of the chamber and the environment causes ink from the higher pressure ink source to pour into the chamber. The incoming volume of ink reduces the pressure differential such that the flexible wall expands outward from the chamber (inflating) to arrive again at the position as shown in FIG. 1, thus starting the three part cycle over again.

FIGS. 4–7 illustrate an exemplary embodiment of the regulator 10' for regulating volumetric flow of ink traveling between an ink source (not shown) and a print head in fluid communication with an ink outlet 14'. As introduced above, the regulator 10' includes a pressurized chamber 16' having an ink inlet 18' in fluid communication with the ink source and the ink outlet 14', which is in fluid communication with the print head (not shown). In this exemplary embodiment, the pressurized chamber 16' is formed by an injection molded base 34 having a floor 36, a pair of elongated opposing side walls 38 and a pair of elongated opposing end walls 40 which collectively form a generally rectangular top opening bounded by the four interior walls. The elongated side walls each include a pair of vertical ribs forming a bearing seat for receiving bearing pins 42 of the lever 24', thereby forming the lever's fulcrum 20'.

The floor 36 includes a generally cylindrical orifice forming the ink outlet 14' and a generally oval orifice 44 over which the flexible wall/diaphragm 22' is mounted. A pair of perpendicular, diametrical spring supports 46 (forming a cross) are positioned within the cylindrical channel of the outlet 14', where the central hub of the cross formed by the pair of diametrical supports 46 extends upwardly to form an axial projection for seating a spring 50 thereabout. Circumferentially arranges gaps 49 between the supports 46 provide fluid communication between the chamber 16' and the ink outlet 14' (see FIG. 5). The spring 50 provides the bias represented by arrow A in FIGS. 1–3.

Figure 4:
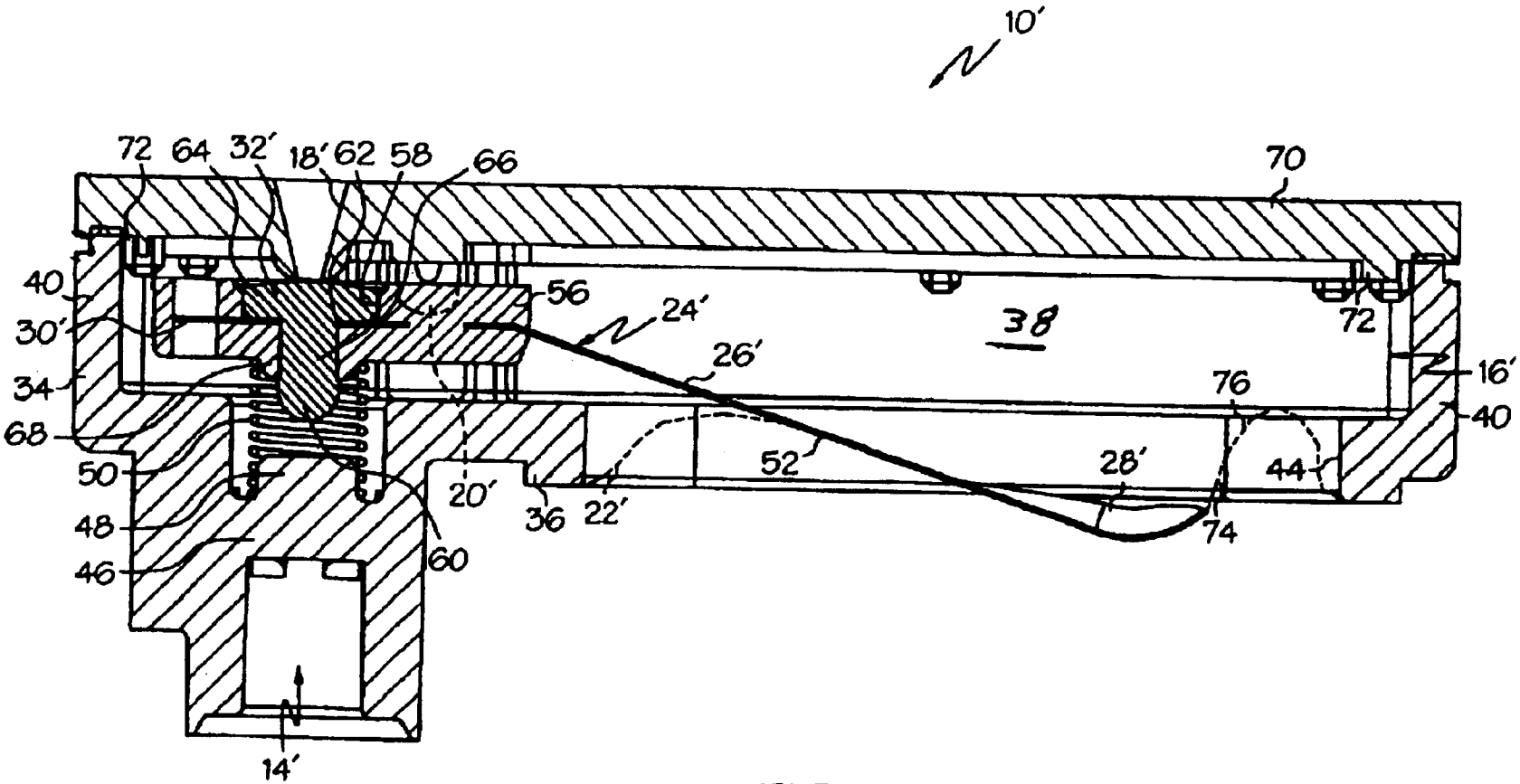
FIG. 4 is an elevational, cross-sectional view of an exemplary embodiment of the present invention.
Figure 5:
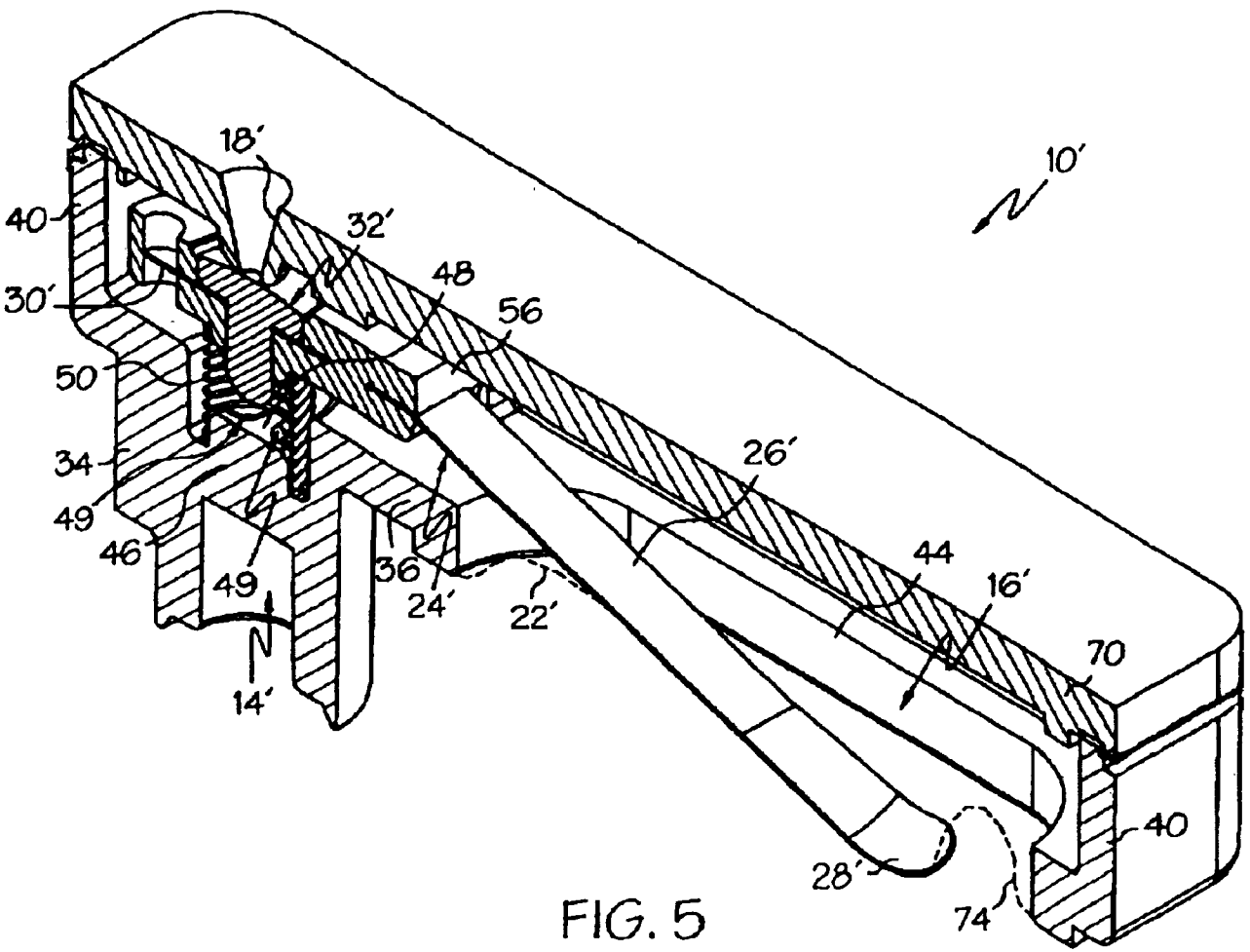
FIG. 5 is perspective, cross-sectional view of the exemplary embodiment of FIG. 4.
Figure 6:
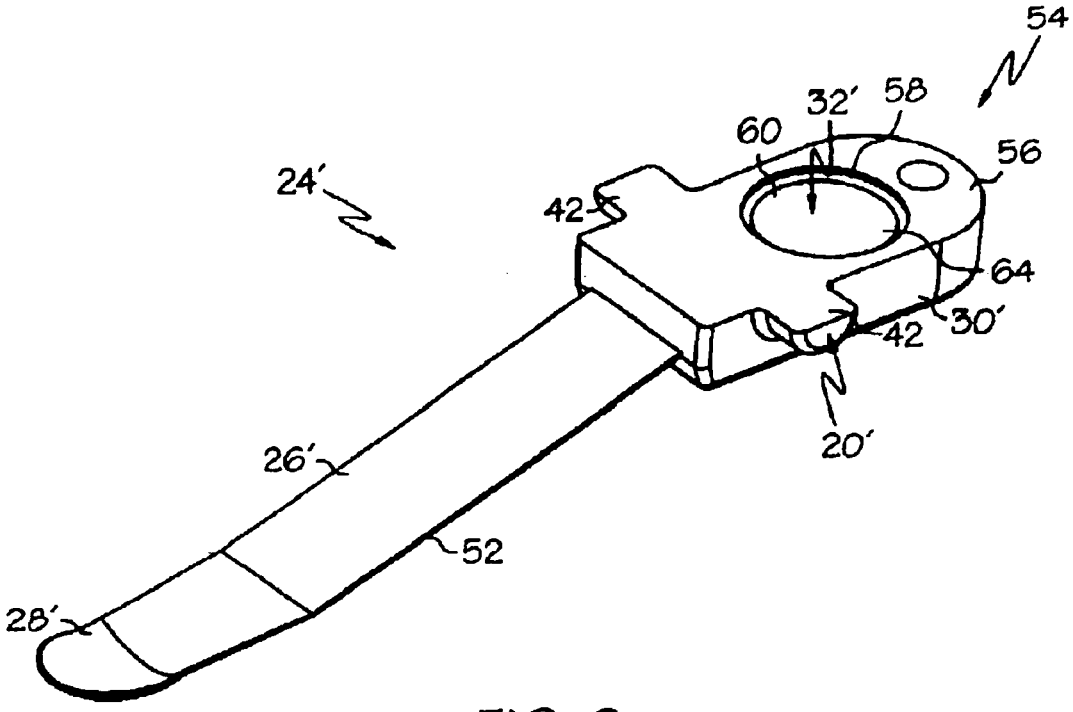
FIG. 6 is an overhead perspective view of a lever component of the embodiments of FIGS. 4 and 5.
Figure 7:
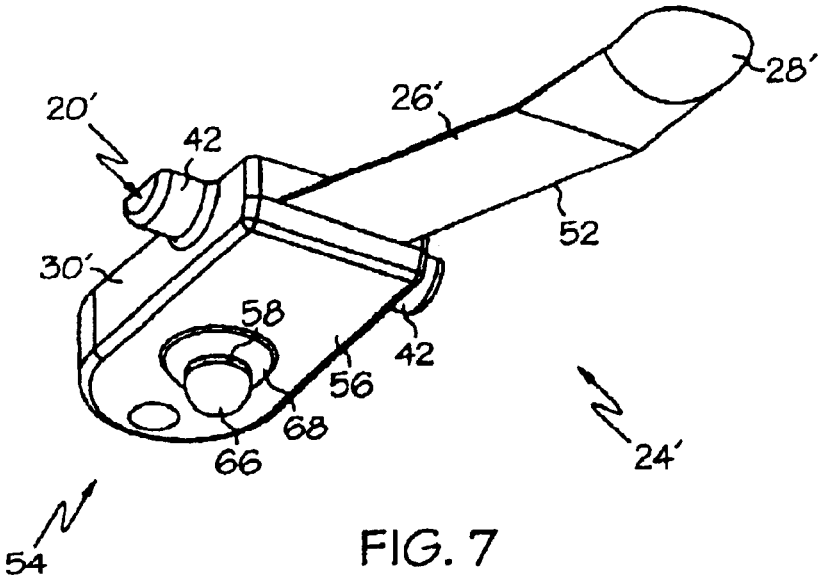
FIG. 7 is an underneath perspective view of the lever component of FIG. 6.

The lever 24' includes a strip of spring metal 52 with a spoon-shaped first end 28' and an encapsulated second end 54. The spoon-shaped end 28' is angled with respect to the encapsulated end 54. The encapsulated end 54 is encapsulated by a block 56 of plastic material where the block 56 includes the pair of bearing pins 42 extending axially outward along the pivot axis of the fulcrum 20'; and also includes a counter-bored channel 58 extending therethrough for seating an elastomeric sealing plug 60 therein. The strip 52 of spring metal also includes a hole 62 extending therethrough that is concentric with the channel 58 in the encapsulated body 56 for accommodating the sealing plug 60. The plug 60 includes a disk-shaped head 64 and an axial stem 66 extending downwardly therefrom. As can be seen in FIG. 4, the plug 60 is axially aligned with the spring 50, and the encapsulated body 56 is seated within the spring 50 by a dome-shaped, concentric projection 68 extending downwardly from the encapsulated body. The spring metal construction of the strip 52 provides the flexibility of the arm 26' described above with respect to FIGS. 1–3.

The base 34 is capped by a plastic lid 70 having a generally rectangular shape matching that of the rectangular opening formed by the elongated side walls 38 and end walls 40 of the base 34. The lid 70 has a generally planar top surface with the exception of a generally conical channel extending there through to form the inlet 18' of the pressurized chamber 16'. The lower side of the lid 70 includes a series of bases or projections 72 for registering the lid on the base 34. In an alternate embodiment, the lid may include a cylindrical tube (coupled to element 71 of FIG. 8, for example), aligned with the inlet 18' forming a hose coupling. The lid 70, of course, is mounted to the body 34 to seal the chamber 16' there within.

The flexible wall 22' is preferably a thin polymer film attached around the outer edges of the oval opening 44 extending through the floor 36 of the base 34. The area of the film 22' positioned within the opening 44 is larger than the area of the opening 44 so that the flexible film 22' can expand outwardly and contract inwardly with the changes of the pressure differential between the pressurized chamber 16' and the outer surface 74 of the film (where the pressure on the outer surface 74 of the film may be ambient pressure, pressure of ink within and ink reservoir, etc.).

Assembly of the regulator includes providing the base 34; positioning the spring 50 on the seat 48; positioning the pins 42 of the lever 24' within the bearing seats formed in the elongated side walls 38 of the base 34 and seating the dome 68 on the spring 50 such that the spoon-shaped end 28' of the lever contacts the inner surface 76 of the flexible wall 22'; and mounting the lid 70 thereover so as to seal the pressurized chamber 16 therein. Operation of the regulator 10' is as described above with respect to the regulator 10 of FIGS. 1–3.

Figure 8:
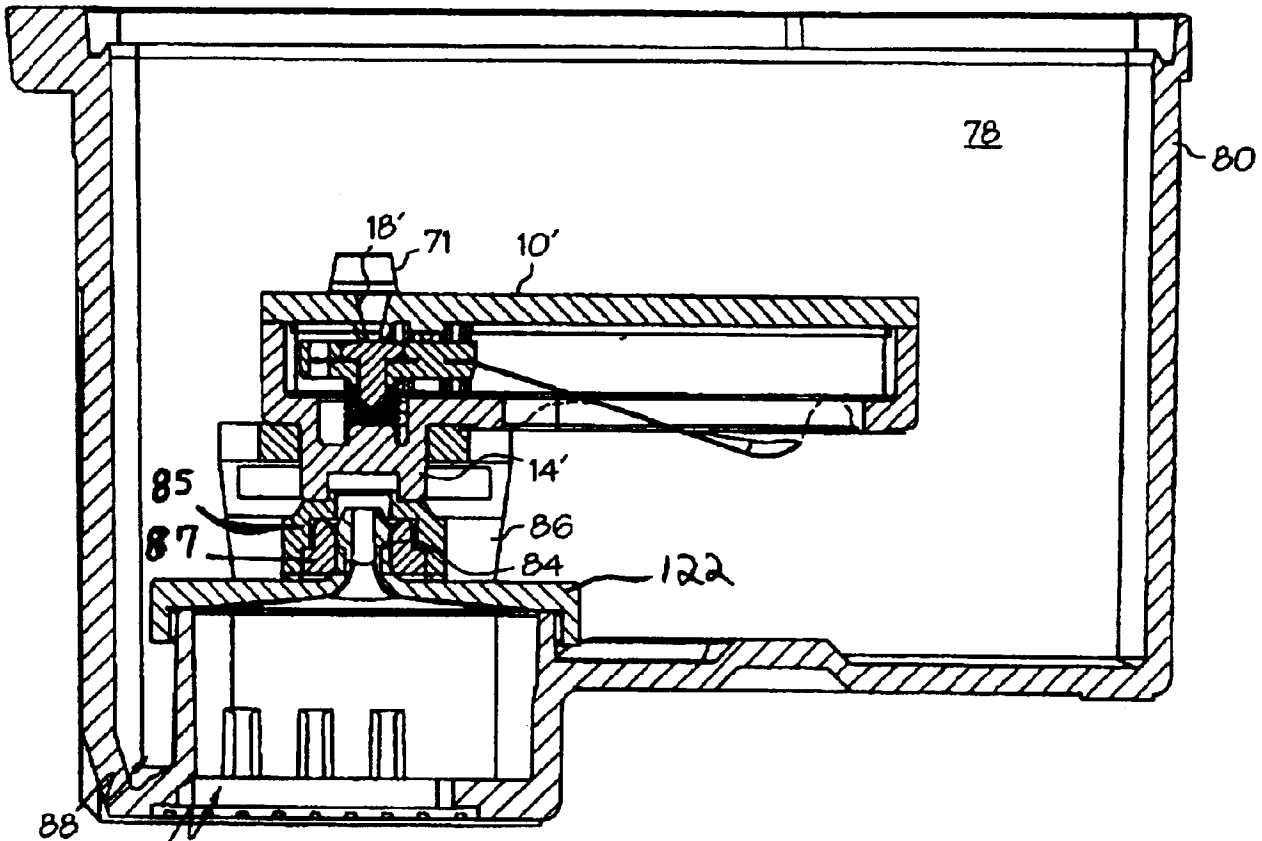
FIG. 8 is an elevational, cross-sectional view of the embodiment similar to the embodiments of FIGS. 4–7 mounted within an ink cartridge.
Figure 9:
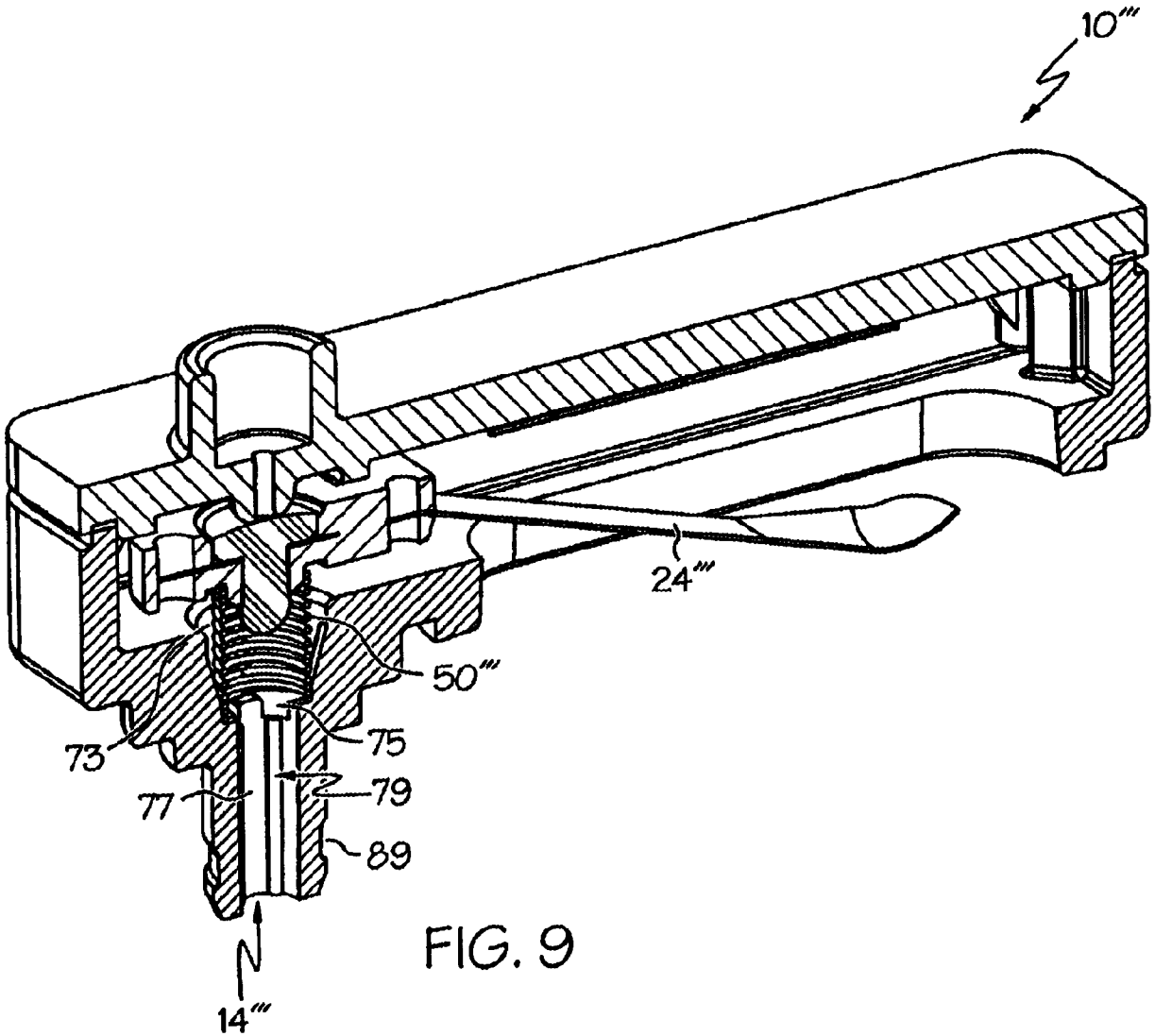
FIG. 9 is a cross-sectional view of an additional exemplary embodiment of the present invention.
Figure 10:
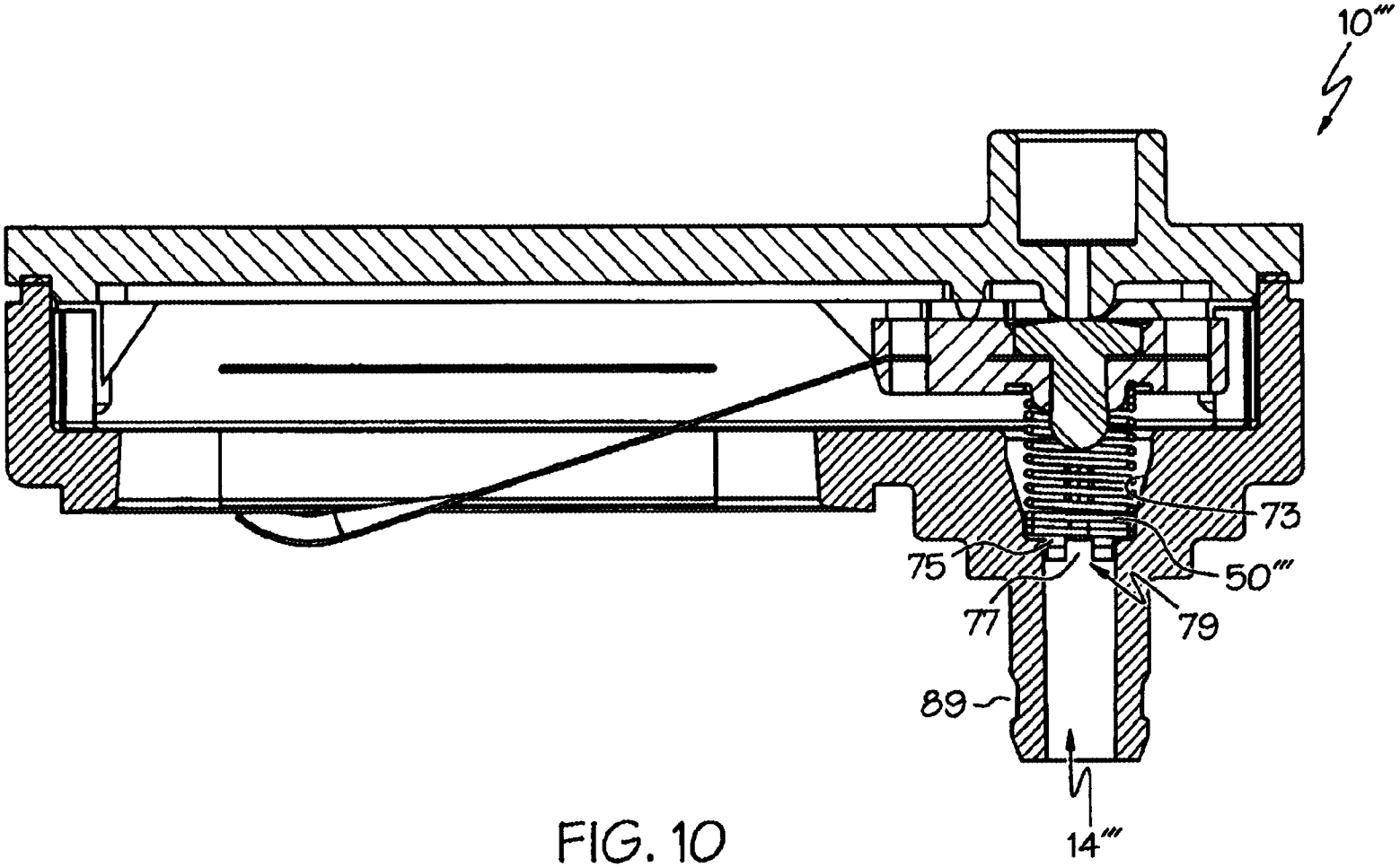
FIG. 10 is an elevated perspective, cross-sectional view of the exemplary embodiment of FIG. 9.
Figure 11:
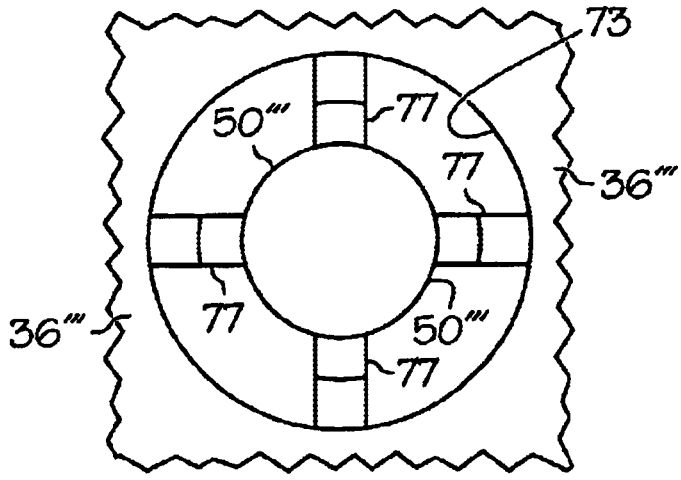
FIG. 11 is an isolated overhead view of the ink outlet of the embodiments of FIGS. 9 and 10.
Figure 12:
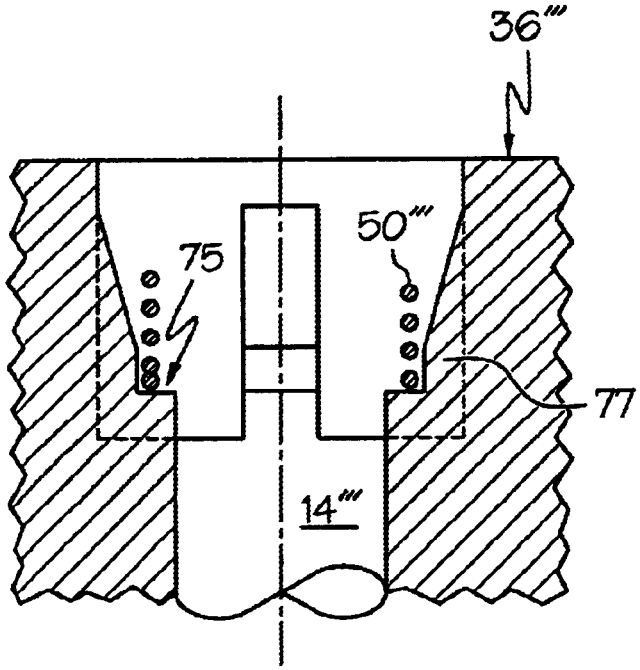
FIG. 12 is an isolated cross-sectional view of the ink outlet of the embodiments of FIGS. 9 and 10.

As shown in FIG. 8, the regulator 10' may be mounted within an ink reservoir 78 of an ink cartridge 80, having a print head 82. The outlet 14' of the regulator 10' is coupled to an inlet 84 of the ink filter cap 122 (that is operatively coupled to the print head 82) by an adapter 85. The adapter 85 is mounted to the regulator outlet 14' and circumscribes a seal 87 that provides a fluidic seal between the adapter 85 and the ink filter cap 122. An collar 86 circumscribes the adapter 85 for additional support. A siphon hose (not shown) provides fluid communication between the lowest point 88 of the reservoir 78 and the hose coupling 71, which is in fluid communication with the regulator's ink inlet 18'. In this embodiment, pressure provided against the outer surface 74 of the flexible wall 22' will be the pressure within the ink reservoir 78.

FIGS. 9–12 illustrate another exemplary embodiment of the regulator 10''' for regulating the volumetric flow of ink traveling between an ink source (not shown) and a print head (not shown) in fluid communication with an ink outlet 14'''. The regulator 10''' includes a majority of the same structural features of the regulator 10' (See FIGS. 4 and 5) discussed above, and may utilize the same lever mechanisms as described above (See FIGS. 6 and 7). However, the regulator 10''' of this exemplary embodiment includes a cylindrical opening 73 in the floor 36''' in fluid communication that abuts a smaller diameter cylindrical ink outlet 14''' (smaller with respect to the cylindrical opening 73), thereby allowing throughput of ink from the pressurized chamber 16''' by way of the ink outlet 14'''.

The cylindrical opening 73 in the floor 36''' includes a spring seat 75 for seating the lower portion of the spring 50''' therein. The spring seat 75 includes a plurality of protrusions extending outward from the walls of the cylindrical opening 73 that provide substantially L-shaped ribs 77 (four in this exemplary embodiment) in elevational cross-section. The vertical portion of the L-shaped ribs 77 tapers and transitions inward toward the interior walls to provide a relatively smooth transition between the rib surfaces potentially contacting the spring 50''' and the interior walls of the cylindrical opening 73. The horizontal portion of the L-shaped rib 77 provides a plateau upon which the spring 50''' is seated thereon. The tapered portions of the ribs 77 work in conjunction to provide a conical guide for aligning the spring 50''' within the spring seat 75.

In assembling this exemplary embodiment, the tapered portion of the L-shaped ribs 77 effectively provides a conical guide for aligning the spring 50''' within the spring seat 75. In other words, the L-shaped ribs 77 within the cylindrical opening 73 provides ease in assembly as the spring 50''' is placed longitudinally approximate the throughput 79 and becomes gravitationally vertically aligned within the opening 73, thereby reducing the level of precision necessary to assembly this exemplary embodiment.

Figure 13:
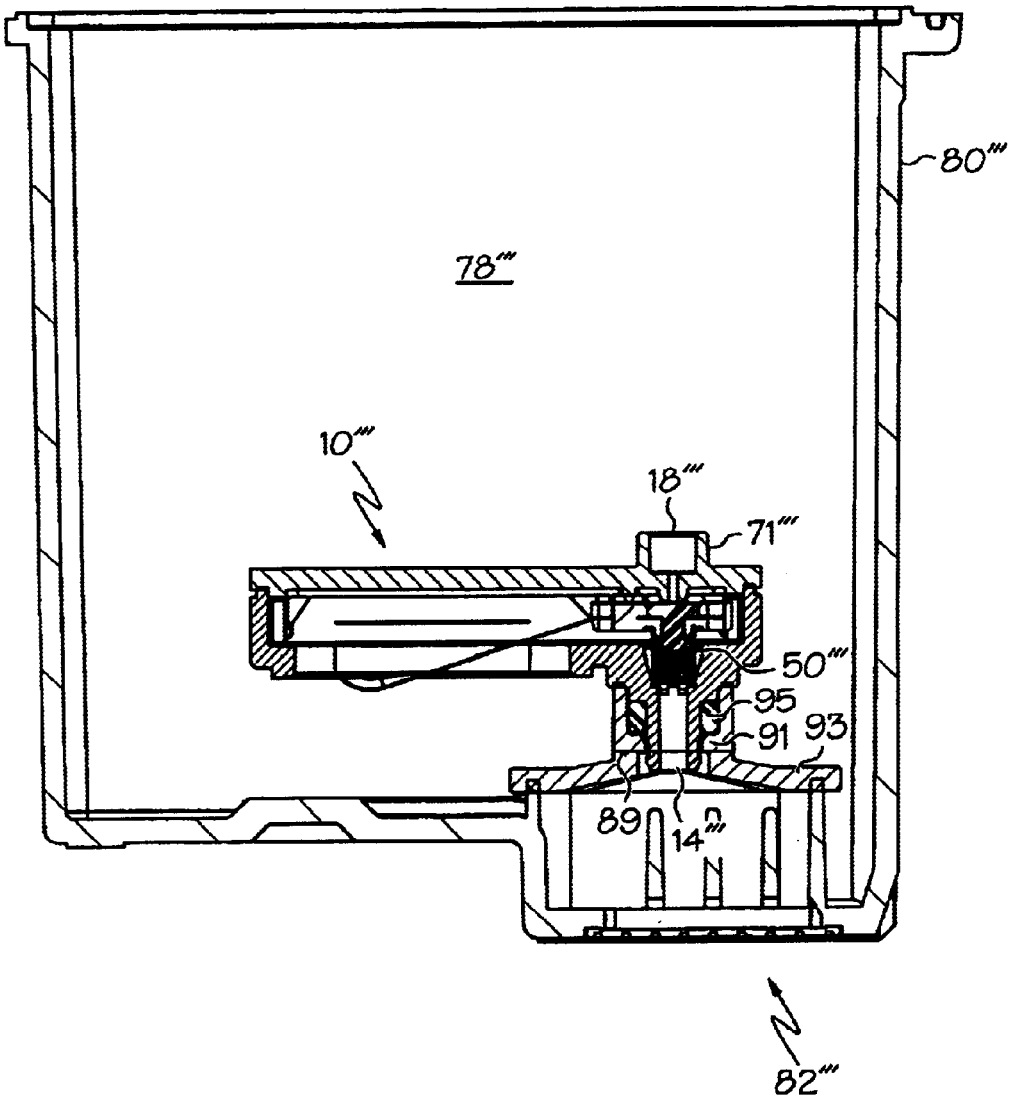
FIG. 13 is an elevational, cross-sectional view of the embodiment similar to the embodiments of FIGS. 9 and 10 mounted horizontally within an ink cartridge.
Figure 14:
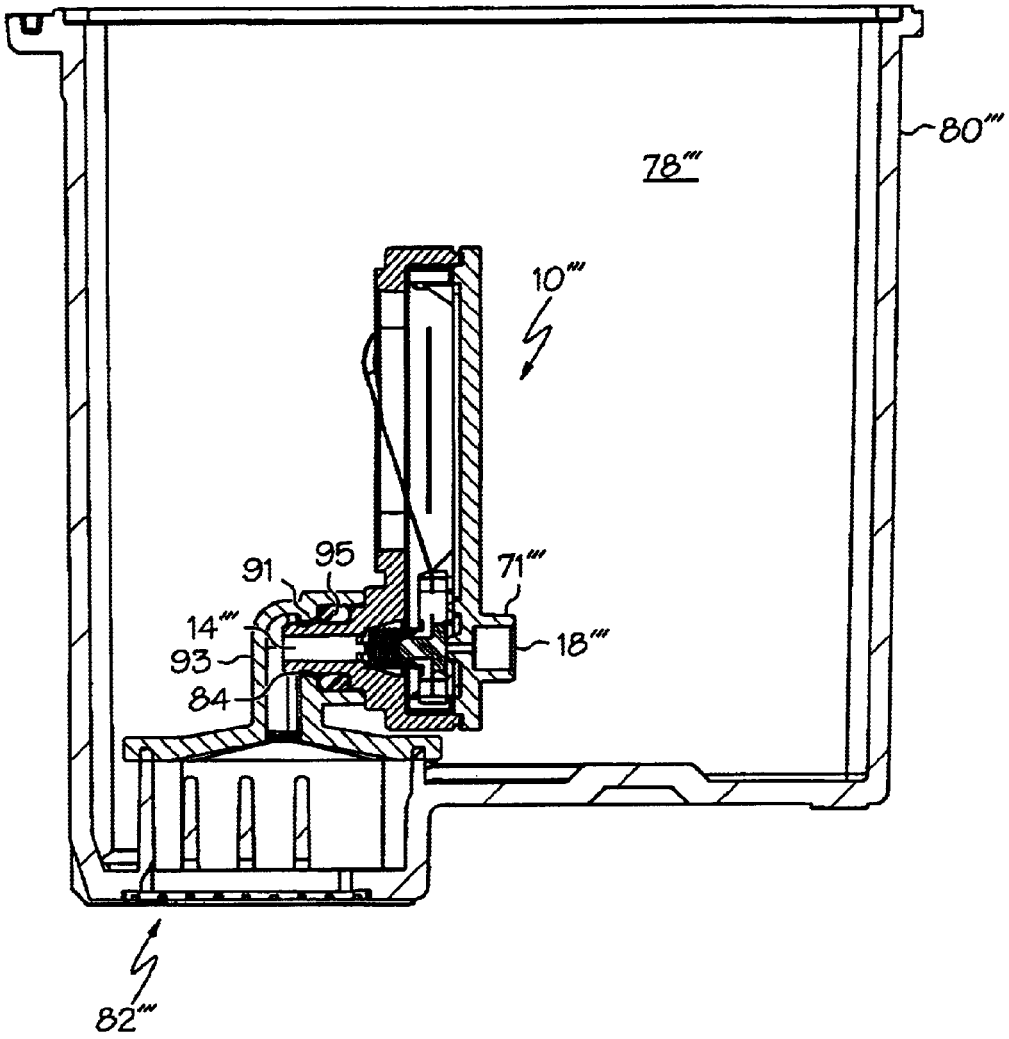
FIG. 14 is an elevational, cross-sectional view of the embodiment similar to the embodiments of FIGS. 9 and 10 Mounted vertically within an ink cartridge.

As shown in FIGS. 13–14, the regulator 10''' may be mounted within an ink reservoir 78''' of an ink cartridge 80''' operatively coupled to a print head 82'''. The ink outlet 14''' of the regulator 10''' includes an annular groove 89 on the outer circumferential surface of the outlet stern that is adapted to mate with a corresponding annular protrusion 91 of an adapter 93 to provide a snap fit therebetween. The adaptor 93 extends from, or is coupled to the inlet of the print head 82. The above-described coupling mechanism can thus be used to orient the regulator 10''' in a generally vertical manner as shown in FIG. 14, or a generally horizontal manner as shown in FIG. 13. To ensure a sealed fluidic interface is provided between the outlet 14''' of the regulator 10''' and the adapter 93, an O-ring 95 or analogous seal is circumferentially arranged about the ink outlet 14''' radially between the outlet stem and the adaptor 93. Upon snapping the regulator 10''' into place so that the annular groove 89 receives the protrusion 91 of the adapter 93, the O-ring 95 is compressed, resulting in a radial compression seal between the adapter 93 and the ink outlet 14'''.

A siphon hose (not shown) may be operatively coupled to the ink inlet 18''' to by way of the hose coupling 71''' to provide fluid communication between a lower ink accumulation point of the reservoir 78''' and the ink inlet 18'''. While the above exemplary embodiments have been described and shown where the coupling adapter 93 is integrated into, and functions concurrently as a filter cap for the print head 82, it is also within the scope and spirit of the present invention to provide an adapter that is operatively mounted in series between a filter cap of the print head 82 and the regulator 10'''.

Figure 15:
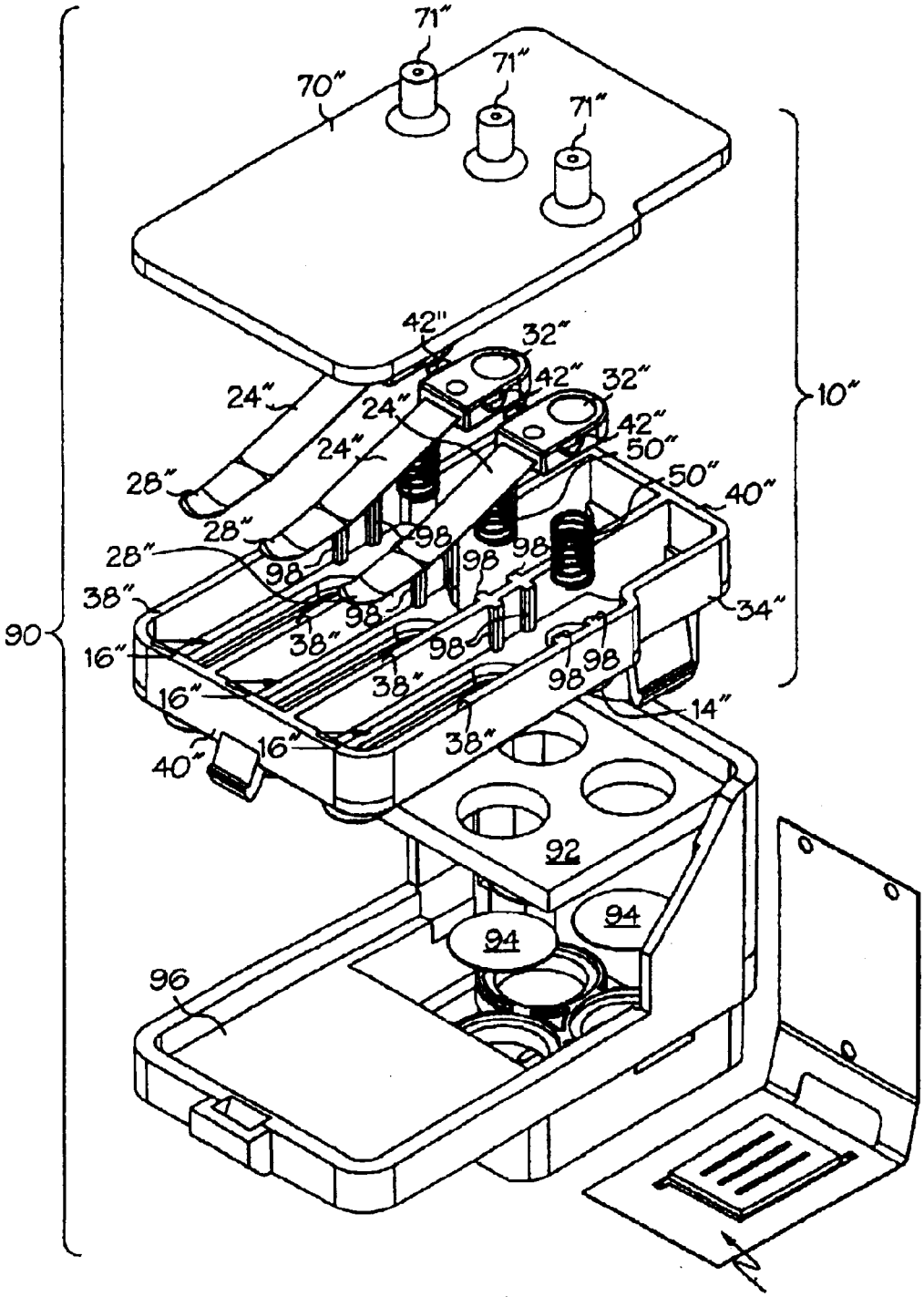
FIG. 15 is a perspective, exploded view of another embodiment of the present invention representing an ink cartridge with multiple ink reservoirs and respective ink regulators according to the present invention provided therein.

As shown in FIG. 15, another second exemplary embodiment of the present invention representing a multi-color print head assembly 90 with three ink sources (not shown) and three respective ink regulators 10" for controlling the volumetric flow of colored inks from the respective ink sources to the tri-color print head 92. Generally, a simple three-color print head will include ink sources comprising yellow colored ink, cyan colored ink, and magenta colored ink. However, it is within the scope of the present invention to provide multi-color print head assemblies having two or more ink sources, as well as single color print head assemblies. Thus, this exemplary embodiment provides a compact regulation system accommodating multi-color printing applications. For purposes of brevity, reference is had to the previous exemplary embodiments as to the general functionality of the individual regulators 10".

The print head assembly 90 includes a multi-chamber body 34", a top lid 70" having three inlet hose couplings 71" for providing fluid communication with the three ink sources, three levers 24", three springs 50", a seal 92, three filters 94, a nose 96, and the tri-color print head heater chip assembly 101. Each chamber 16" is generally analogous to the chamber described in the previous exemplary embodiments.

FIG. 15 provides a view of the vertical ribs 98 provided on the elongated side walls 38", and optionally on the underneath side of the top lid 70", providing the bearing seats for the bearing pins 42" of the levers 24" as discussed above with respect to the above exemplary embodiments. Further, each chamber includes internal bearing seats, an opening accommodating inward movement of the flexible wall (not shown), and a spring guide (not shown). Likewise, each lever 24" is analogous to that described in the above exemplary embodiment.

Figure 16:
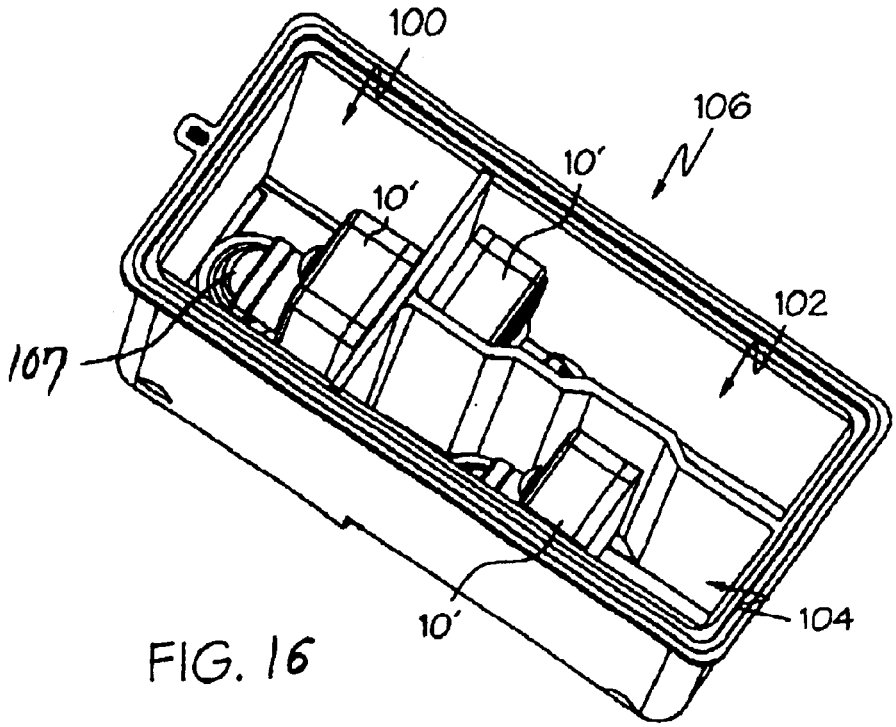
FIG. 16 is a perspective overhead view of another embodiment of the present invention representing an ink cartridge with multiple ink reservoirs and respective ink regulators according to the present invention provided therein.
Figure 17:
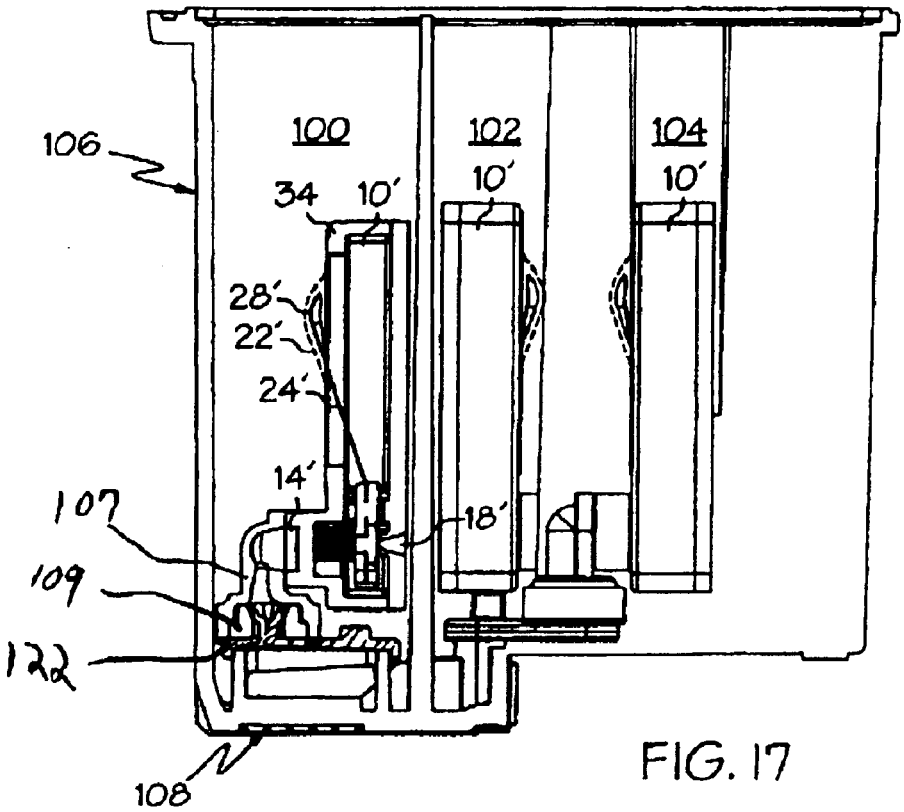
FIG. 17 is an elevational, cross-sectional view of the embodiment of FIG. 16.

Referencing FIGS. 16 and 17, three of the regulators 10' are housed within respective ink reservoirs 100, 102 and 104 contained within a multi-color printer ink cartridge 106. The regulators 10' are generally oriented in a vertical fashion with the ink inlets 18' and ink outlets 14' positioned toward the bottom of the respective reservoirs, and the spoon-shaped ends 28' of the levers 24' directed upwards. Each of the regulators 10' includes an adapter 107 that mounts the outlet 14' of the regulator to the filter cap 122. The ink filter cap 122 is operatively coupled to the print head 108. Each adapter 107 circumscribes a seal 109 that maintains a sealed fluidic interface between the outlet 14' of the regulator and the inlet 84 of the ink filter cap 122. In such an arrangement it is possible for each of the three respective regulators to function independently of one another, and thus, the fluid level within one of the respective reservoirs has no bearing upon the functional nature of the regulators in the opposing reservoirs. It should also be noted that each of the regulators may include a siphon/hose providing fluid communication between the fluid inlet 18' and the floor of the respective fluid reservoirs, such that the lower pressure within the fluid regulator is able to draw in almost all of the fluid within a respective chamber. Each of the respective reservoirs provides an individual fluid conduit to the multi-color print head 108 while functioning independent of whether or not the respective regulator is submerged completely within ink, partially submerged within ink or completely surrounded by gas. It should also be understood that this exemplary embodiment could easily be adapted to provide two or more individual fluid reservoirs by simply isolating each respective reservoir having its own individual fluid regulator contained therein and operatively coupled to the regulator such that the ink flow from the reservoir must be in series or must go through the regulator before exiting the respective reservoir.

Each of the respective reservoirs provides an individual fluid conduit to the multi-color print head 108 while functioning independent of whether or not the respective regulator is completely submerged within ink, partially submerged within ink or not submerged at all within ink. It should also be understood that this exemplary embodiment could easily be adapted to provide one or more separable fluid reservoirs by simply abandoning any use of common walls and providing each reservoir 100, 102, 104 with its own separate containment walls housing ink and an individual fluid regulator 10' therein. Likewise, as the regulator 10, 10' may be fully submerged beneath the surface of the ink and operative when the flexible wall 22, 22' is in fluid communication with a liquid on its external surface, it is no longer necessary to seal the perimeter of the regulator 10' to the ink cartridge or to the print head cartridge 106 walls other as a means of attachment. Increased depths of submersion of the regulator 10, 10' may be accommodated by simply increasing the spring force of the spring 50, 50" biasing the lever to compensate for the increased pressure applied to the exterior of the flexible wall 22, 22'. Further, it is not necessary to provide a gas pocket in fluid communication with the external surface of the flexible wall, as the present invention is equally operative with a liquid or gas contacting the flexible wall. This also provides more efficient use of space and/or an increased ink capacity within the ink cartridge or print head cartridge.

Each of the above exemplary fluid regulators 10, 10' provide operative backpressure ranges of between 5 to 28 centimeters of water column negative pressure. These ranges also provides the working parameters between which the seal 32, 32" must be selectively positioned to open and close the ink inlet 18 to allow fluid communication between the interior of the pressurized chamber 16, 16" and the ink inlet to replace the swept volume ranging from about 0.1 and 1.5 mL. The "swept volume" generally refers to the volume of ink that flows out of the pressurized chamber after the seal has closed and before the ink inlet is reopened.

Following from the above description and invention summaries, it should be apparent to those of ordinary skill in the art that, while the methods and apparatuses herein described constitute exemplary embodiments of the present invention, the inventions contained herein are not limited to these precise embodiments and that changes may be made to them without departing from the scope of the inventions as defined by the claims. Additionally, it is to be understood that the invention is defined by the claims and it is not intended that any limitations or elements describing the exemplary embodiments set forth herein are to be incorporated into the meanings of the claims unless such limitations or elements are explicitly listed in the claims. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A print head and regulator assembly for a printer comprising:

a print head;

an ink source; and a regulator for regulating the flow of ink between the ink source and the print head, the regulator including, a pressurized chamber having an ink inlet in fluid communication with the ink source, an ink outlet in fluid communication with the print head, an opening extending through a chamber wall, and a flexible film covering the opening, the flexible film having an inner surface facing an interior of the pressurized chamber and an outer surface in contact with a liquid;

a lever including a flexible arm positioned in proximity to the inner surface of the flexible film and an opposing arm operatively coupled to a seal that closes the ink inlet when the lever is in a first position and opens the ink inlet when the lever is pivoted to a second position, the lever being biased to the first position;

wherein a higher pressure differential across the flexible film brings about a higher force acting upon the flexible arm to overcome the bias and pivot the lever to the second position opening the ink inlet; and wherein a lower pressure differential across the flexible film brings about a lesser force acting upon the flexible arm resulting in the lever succumbing to the bias and repositioning the seal at the first position, closing the ink inlet.

2. The print head and regulator assembly of claim 1, wherein:

the ink source is an ink reservoir; and the regulator is at least partially submerged within the ink reservoir such that the liquid contacting the outer surface of the flexible film is ink within the ink reservoir.

3. The print head and regulator assembly of claim 2, wherein an operating pressure on the interior of the pressurized chamber is between about 5 centimeters water column negative pressure and about 28 centimeters water column negative pressure.

4. The print head and regulator assembly of claim 2, wherein a volume of ink exiting the pressurized chamber between sequential occurrences of the pivoting lever in the second position ranges from about 0.1 mL and about 1.5 mL.

5. The print head and regulator assembly of claim 2, wherein the higher pressure differential ranges from about 28 centimeters water column to about 10 centimeters water column.

6. The print head and regulator assembly of claim 5, wherein the lower pressure differential ranges from about 5 centimeters water column to about 20 centimeters water column.

7. The print head and regulator assembly of claim 2, wherein the lower pressure differential ranges from about 5 centimeters water column to about 20 centimeters water column.

8. The print head and regulator assembly of claim 2, wherein the regulator is fully submerged within the ink reservoir.

9. The print head and regulator assembly of claim 2, wherein:

the lever is biased to the first position by a spring; and a spring force is dependent upon a depth of submersion of the regulator within the ink reservoir.

10. The print head and regulator assembly of claim 1, wherein an operating pressure on the interior of the pressurized chamber is between about 5 centimeters water column negative pressure and about 28 centimeters water column negative pressure.

11. The print head and regulator assembly of claim 1, wherein a volume of ink exiting the pressurized chamber between sequential occurrences of the lever pivoting to the second position ranges from about 0.1 mL and about 1.5 mL.

12. The print head and regulator assembly of claim 1, wherein the higher pressure differential ranges from about 28 centimeters water column to about 10 centimeters water column.

13. The print head and regulator assembly of claim 12, wherein the lower pressure differential ranges from about 5 centimeters water column to about 20 centimeters water column.

14. The print head and regulator assembly of claim 1, wherein the lower pressure differential ranges from about 5 centimeters water column to about 20 centimeters water column.

15. The print head and regulator assembly of claim 1, wherein the ink inlet is operatively coupled to a siphon tube in fluid communication with the ink source.

16. The print head and regulator assembly of claim 1, wherein the flexible film is a non-elastomeric film.

17. The print head and regulator assembly of claim 1, wherein the flexible film contacts and spatially conforms to the shape of the flexible arm between the first and second positions.

18. An ink cartridge comprising:

at least one ink reservoir; and at least one regulator for regulating the flow of ink between the ink reservoir and an ink cartridge outlet, the regulator including, a pressurized chamber having an ink inlet in fluid communication with the ink reservoir, an ink outlet in fluid communication with the ink cartridge outlet, an opening extending through a chamber wall, and a flexible film covering the opening, the flexible film having an inner surface facing an interior of the pressurized chamber and an outer surface in contact with a liquid;

a lever including a flexible arm positioned in proximity to the inner surface of the flexible film and an opposing arm operatively coupled to a seal that closes the ink inlet when the lever is in a first position and opens the ink inlet when the lever is pivoted to a second position, the lever being biased to the first position;

wherein a higher pressure differential across the flexible film brings about a higher force acting upon the flexible arm to overcome the bias and pivot the lever to the second position opening the ink inlet; and wherein a lower pressure differential across the flexible film brings about a lesser force acting upon the flexible arm resulting in the lever succumbing to the bias and repositioning the seal at the first position, closing the ink inlet.

19. The print cartridge of claim 18, wherein the regulator is at least partially submerged within the ink reservoir such that the liquid contacting the outer surface of the flexible film is ink within the ink reservoir.

20. The print cartridge of claim 19, wherein an operating pressure on the interior of the pressurized chamber is between about 5 centimeters water column negative pressure and about 28 centimeters water column negative pressure.

21. The print cartridge of claim 19, wherein a volume of ink exiting the pressurized chamber between sequential occurrences of the lever pivoting to the second position ranges from about 0.1 mL and about 1.5 mL.

22. The print cartridge of claim 19, wherein the higher pressure differential ranges from about 28 centimeters water column to about 10 centimeters water column.

23. The print cartridge of claim 22, wherein the lower pressure differential ranges from about 5 centimeters water column to about 20 centimeters water column.

24. The print cartridge of claim 19, wherein the lower pressure differential ranges from about 5 centimeters water column to about 20 centimeters water column.

25. The print cartridge of claim 19, wherein the regulator is fully submerged within the ink reservoir.

26. The print cartridge of claim 19, wherein:

the lever is biased to the first position by a spring; and a spring force is dependent upon a depth of submersion of the regulator within the ink reservoir.

27. The print cartridge of claim 19, further comprising a plurality of the ink reservoirs and a respective plurality of the regulators at least partially submerged within respective ink reservoirs.

28. The print cartridge of claim 18, wherein an operating pressure on the interior of the pressurized chamber is between about 5 centimeters water column negative pressure and about 28 centimeters water column negative pressure.

29. The print cartridge of claim 18, wherein a volume of ink exiting the pressurized chamber between sequential occurrences of the lever pivoting to the second position ranges from about 0.1 mL and about 1.5 mL.

30. The print cartridge of claim 18, wherein the higher pressure differential ranges from about 28 centimeters water column to about 10 centimeters water column.

31. The print cartridge of claim 30, wherein the lower pressure differential ranges from about 5 centimeters water column to about 20 centimeters water column.

32. The print cartridge of claim 18, wherein the lower pressure differential ranges from about 5 centimeters water column to about 20 centimeters water column.

33. The print cartridge of claim 18, wherein the ink inlet is operatively coupled to a siphon tube in fluid communication with the ink source.

34. The print cartridge of claim 18, wherein the flexible film is a non-elastomeric film.

35. The print cartridge of claim 18, wherein the flexible film contacts and spatially conforms to the shape of the flexible arm between the first and second positions.

36. A method of regulating the flow of ink from an ink source to a print head nozzle comprising the steps of:

positioning an ink regulator having a pressurized chamber in fluid communication with an ink stream between an ink source and a print head;

contacting a flexible wall of the ink regulator with a liquid responsive to a pressure exerted upon ink upstream from the ink regulator;

actuating the flexible wall in response to a pressure differential across the flexible wall between a fluid inside the pressurized chamber and the liquid; and opening or closing at least one valve selectively in response to actuation of the flexible wall to provide fluid communication between a first point and a second point of the ink stream.

37. The method of claim 36, wherein the positioning step includes the step of submerging, at least partially, the ink regulator within the ink source such that the liquid contacting the flexible wall of the ink regulator is ink in the ink source.

38. The method of claim 37, wherein the valve is biased to a closed position and the method further comprises the step of correlating the bias of the valve with a depth of submersion of the ink regulator within the ink source.

39. The method of claim 36, wherein the first point includes any point upstream from the ink regulator.

40. The method of claim 39, wherein the second point includes any point downstream from the ink regulator.

41. The method of claim 36, further comprising the step of pivoting a lever in response to the actuating step to open the valve, wherein the valve is biased closed and resists the lever pivoting.

42. The method of claim 36, wherein an operating pressure of the pressurized chambers is between about 5 centimeters water column negative pressure and about 28 centimeters water column negative pressure.

43. The method of claim 36, wherein the flexible wall is a non-elastomeric film bonded over an opening in the pressurized chamber.

44. The method of claim 36, wherein a volume of ink exiting the pressurized chambers between sequential opening of the valve ranges from about 0.1 mL and about 1.5 mL.

* * * * *

UNITED STATES PATENT AND TRADEMARK OFFICE

CERTIFICATE OF CORRECTION

PATENT NO. : 6,786,580 B1
DATED : September 7, 2004
INVENTOR(S) : Trevor Daniel Gray et al.

It is certified that error appears in the above-identified patent and that said Letters Patent is hereby corrected as shown below:

Column 14,
Lines 58 and 64, replace “chambers” with -- chamber --.

Signed and Sealed this

Nineteenth Day of April, 2005

JON W. DUDAS
*Director of the United States Patent and Trademark Office*